United States Patent [19]

Spears

[11] 4,332,533

[45] Jun. 1, 1982

[54] FLUID PUMP

[75] Inventor: Harry L. Spears, Houston, Tex.

[73] Assignee: Watson International Resources, Ltd., Houston, Tex.

[21] Appl. No.: 75,318

[22] Filed: Sep. 13, 1979

[51] Int. Cl.[3] ..... F04B 7/00

[52] U.S. Cl. ..... 417/513

[58] Field of Search ..... 417/511, 512, 513, 259, 417/268, 552, 559, 553, 554

[56] References Cited

U.S. PATENT DOCUMENTS

| | | | |
|---|---|---|---|
| 193,350 | 7/1877 | Sheriff | 417/553 |
| 1,550,963 | 8/1925 | Jackson | 417/259 |
| 2,136,636 | 11/1938 | Rotter | 417/511 |
| 2,464,347 | 3/1949 | Roofe | 417/554 |
| 2,615,400 | 10/1952 | Fuqua et al. | 417/554 |
| 2,615,401 | 10/1952 | Mock | 417/260 |
| 2,723,625 | 11/1955 | Nichols | 417/569 |
| 2,743,677 | 1/1956 | Fleming | 417/569 |
| 2,771,902 | 11/1956 | Winchester | 417/455 |
| 3,074,352 | 1/1963 | Vincent | 417/259 |
| 3,136,265 | 6/1964 | Chenault | 417/554 |
| 3,143,080 | 8/1964 | Sutliff | 417/554 |
| 3,186,354 | 6/1965 | Mahoney | 417/513 |
| 3,586,464 | 6/1971 | Croue et al. | 417/260 |
| 3,697,199 | 10/1972 | Spears | 417/430 |
| 3,941,516 | 3/1976 | Soberg | 417/552 |

*Primary Examiner*—William L. Freeh

*Attorney, Agent, or Firm*—Pravel, Gambrell, Hewitt, Kirk & Kimball

[57] ABSTRACT

A fluid pump with a standing valve above a traveling piston within a housing bore. The traveling piston is mounted on a rod which extends through the housing to a drive mechanism. The traveling piston is constructed so that on the downstroke fluid may pass through a valve in the piston to the bore area above the piston. At the bottom of the downstroke side inlet ports are exposed above the traveling piston to allow more fluid to enter into the bore area above the traveling piston. There is a bottom inlet for fluid to enter during the downstroke of the traveling piston. The upper standing valve raises during the upstroke to unseal outlet ports.

4 Claims, 9 Drawing Figures

FIG. 6
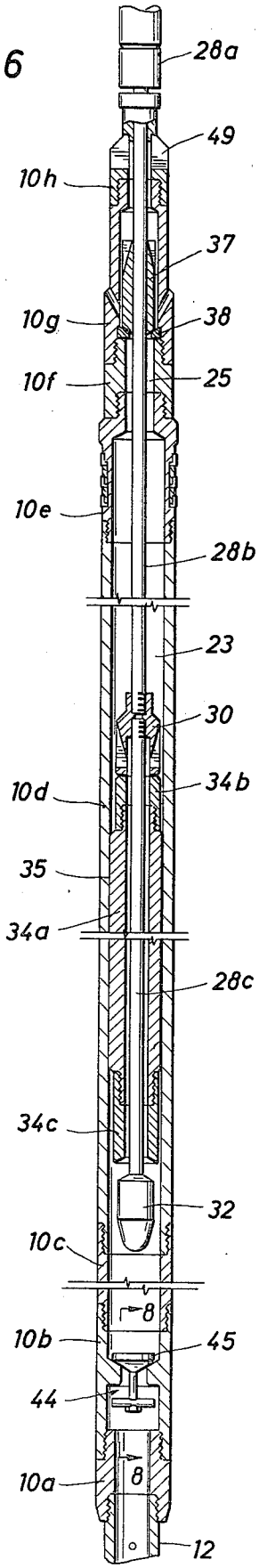
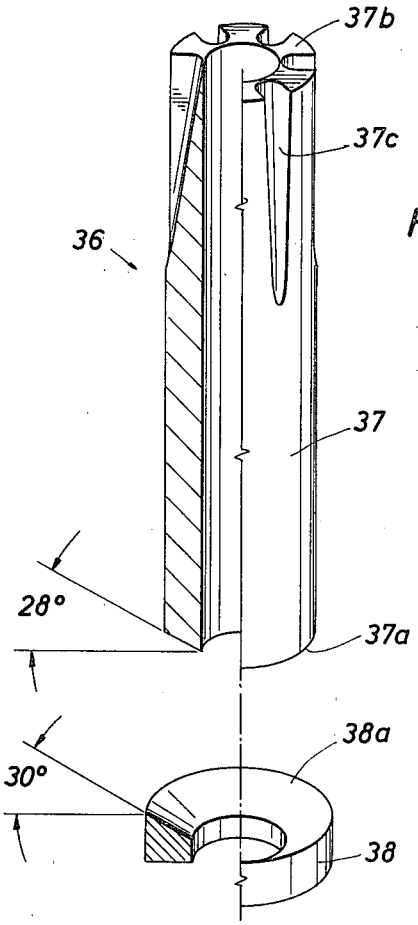
FIG. 7
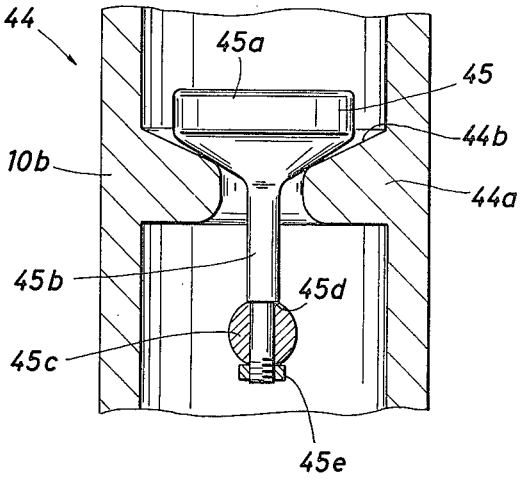
FIG. 8

FLUID PUMP

TECHNICAL FIELD

This invention relates to fluid pumps. More specifically, the invention relates to fluid pumps used downhole in oil wells.

PRIOR ART

A completed oil well typically requires some type of pump to be positioned downhole to elevate petroleum fluid from the reservoir, through production tubing, to the surface. Many problems have been associated with this type of pump, sometimes referred to as a "sucker rod" pump since typically such pumps are driven by a reciprocating rod which extends downhole through the production tubing. It can be quickly appreciated that a sucker rod pump should be highly reliable since it has to be retrieved from downhole to be repaired or replaced.

One type of sucker rod pump used in an effort to reduce problems associated with downhole production such as gas lock and fluid pounding, includes a standing valve positioned above a traveling piston in a common housing. The traveling piston is connected to the sucker rod in order to pump fluid upwardly through the standing valve.

Two basic types of pumps using a standing valve located in a common housing above a piston connected to the sucker rod are known to the inventor. The first, as illustrated by Welling (U.S. Pat. No. 2,517,952) and Spears (U.S. Pat. No. 3,697,199), has side inlet ports situated so that at the bottom of the traveling piston downstroke the fluid is drawn into the pump housing bore above the traveling piston by a pressure differential. The second type, as illustrated by Shutt (U.S. Pat. No. 1,812,667), has a valve within the traveling piston that allows oil from a bottom inlet to pass into the bore above the piston as the traveling piston descends.

Both types have specific problems associated with them. In the first type, a formation with substantial pressure may make it difficult for the piston on the downstream to move past the side inlet ports against the pressure in the well. Furthermore, the amount of time allowed for fluid entrance may be insufficient to totally fill the available cavity, which significantly reduces production as a portion of the upward stroke will not be used for production. In the second type, the fluid admitted through the valve in the traveling piston during the downstroke may also be insufficient to totally fill the cavity, thus decreasing efficiency. This is especially the case with high viscous crude wells.

SUMMARY OF THE INVENTION

This invention is to provide a new and improved fluid pump, and in particular, a sucker rod driven pump which is usable in oil, gas and water wells. In one embodiment, this invention will be used as a downhole production pump, for oil well production. The present invention consists of a pump with an upper standing valve and a traveling piston mounted within a housing bore. The traveling piston is mounted on a piston rod which extends through the housing into connection with a drive mechanism such as a sucker rod. The traveling piston is constructed so that on the downstroke fluid may pass through a valve in the piston to the bore area above the traveling piston. At the bottom of the downstroke, side inlet ports are exposed above the traveling piston to allow more fluid to enter into bore area above the traveling piston. On the upstroke, the side inlet ports, as well as the valve on the traveling piston, are sealed and the oil is pushed upwardly by the piston through an upper standing valve and through housing outlet ports. The upper valve is constructed to maximize fluid flow and minimize wear.

BRIEF DESCRIPTION OF THE DRAWINGS

FIG. 6 is a cross-section of an alternative embodiment of the pump with a third valving means;

FIG. 7 is a cutaway detail view of the upper cylindrical valving means and its seat;

FIG. 8 is a cross-section detail of the third valving means illustrated in FIG. 6.

DESCRIPTION OF THE PREFERRED EMBODIMENT

Figure 1:
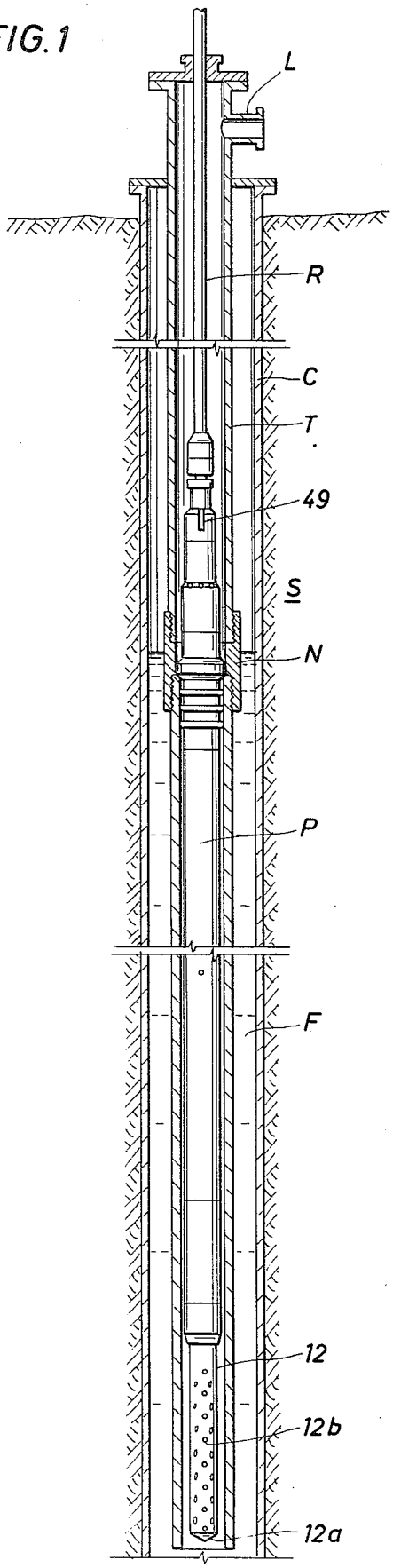
FIG. 1 is an elevational view of the pump of the present invention in its environment.

With reference to the drawings, the pump P of the present invention is designed to operate in a conventional oil well structure as shown in FIG. 1. This structure is placed within a subsurface formation S within a casing C. The casing C is perforated to allow petroleum fluid F to flow from the formation S into the casing C. Inside the casing C is a string of tubing T in which the pump P is seated on a nipple N within the tubing T. The nipple N also seals the tubing T above the nipple N from the tubing below the nipple N. As with conventional pumps, the pump P is driven by a reciprocating linkage of sucker rods R to raise fluid from below the seating nipple N and expel it into the tubing T above the nipple N. This pumping action eventually fills the tubing T and forces fluid to a production line L at the well surface.

The pump P as shown by FIG. 1, primarily comprises a generally cylindrical housing 10 formed with a top bore portion 24 and bottom bore portion 26, a rod 28 extending through the top bore portion 24 into the bottom bore portion 26, a lower cylindrical valve means 34 mounted on the rod 28 between rod upper stop 30 and lower stop 32, and capable of forming a seal with lower rod stop 32, an upper cylindrical valve means 36 mounted on the rod 28 in the top bore portion 24, outlet means 40 sealable by the upper cylindrical valve means 36, side inlet means 42 sealable by lower cylindrical valve means 34 and bottom inlet means 14 formed in the lower end cylinder **10*b* of the housing 10**.

Details in the construction of the pump P of the present invention may best be described by reference to FIGS. 2–5 of the drawings. The generally cylindrical, hollow housing 10 of the pump P is formed by a series of threadly connected housing cylinder sections labeled in ascending order **10*a* through 10*h*. Within the housing 10, 10*a* is a connector cylinder, 10*b* is the lower end cylinder, 10*c* is a spacer cylinder, 10*d* is the main cylinder, 10*e* is the hold-down body, 10*f* is the interior section cylinder, 10*g* is the outlet cylinder, and 10*h*** is the upper end cylinder. These areas will be described more fully below.

An upper housing section 13*a* is formed by housing cylinders 10*g* and 10*h*. A lower housing section 13*b* is formed by housing cylinder 10*a*–10*e*. An interior section 13*c* is formed by the interior section cylinder 10*f*. Connected to the connecting cylinder 10*a* is a conventional gas filter 12 which is a tube with a closed end 12*a* and having multiple perforations 12*b* through which the petroleum fluid F flows into the bottom inlet 14 formed by the hollow lower end cylinder 10*b*. The gas filter 12 is designed to reduce the amount of gas entering with the petroleum fluid F.

The hold-down body 10*e*, of conventional design, serves several purposes. The body 10*e* is used to locate the pump at the proper space in the seating nipple N, the body 10*e* allows the pump to be held down at the proper location within the tubing T and the body 10*e* seals the upper part of the tubing T off from the petroleum fluid F below the nipple N. The hold-down body 10*e* includes a radially enlarged box section 16 extending from a smaller shank portion 18. The external dimensions of the box section 16 are greater than the internal dimensions of the seating nipple N which prevents the pump P from moving below the seating nipple N in the tubing T. The external dimensions of the housing cylinders 10*a*–10*d* and shank portion 18 of cylinder 10*e* below the enlarged box section 16 are less than the internal dimensions of the seating nipple N which thereby permits the lower portion of the pump P to extend below the seating nipple as illustrated in FIG. 1 of the drawings.

The outside wall of the smaller shank portion 18 of the hold-down body 10*e* supports a conventional sealing assembly which includes a plurality of resilient seating cups 20 axially spaced from each other by spacers 22. The seating cups 20 and the spacers 22 are fixed against axial movement with respect to the hold-down body 10*e* by means of a jam nut (not shown), which engages threads on the shank portion 18 to hold the sealing assembly securely against the enlarged box section 16. As best illustrated in FIG. 1, the seating cups 22 form a leak proof seal between the pump 10 and the seating nipple N which isolates the internal tubing T above the nipple N from the areas below the nipple N.

A generally cylindrical bore 23 is formed within the housing 10 by the generally cylindrical interior surfaces of the housing cylinders 10*a*–10*h*. This bore 23 is divided into top bore portion 24 formed within housing cylinders 10*g* and 10*h* and a bottom bore portion 26 formed within housing cylinders 10*a*–10*e*. The bores 24 and 26 are separated by the intermediate bore section 25 formed by the interior walls of enlarged box section 16, and interior section cylinder 10*f*, which have a smaller diameter than the walls forming bore portions 24 and 26.

Extending through the housing upper end cylinder 10*h*, the top bore portion 24, the intermediate bore portion 25, and into the lower bore portion 26 is a rod 28. Upper end cylinder 10*h* has a radially reduced top portion to serve as a rod guide. The top 28*a* of the rod 28 is threadly connected to the termination of the sucker rods R. The sucker rods R provide reciprocal power to the rod 28 to give it a reciprocal motion with an upstroke and a downstroke. The rod top 28*a* is enlarged in relation to the diameter of the rod 28 and the internal diameter of the upper end cylinder 10*h* to form a stop for the downward motion of the rod 28. The rod 28 is formed in two sections, an upper section 28*b* and a lower section 28*c*. The upper section 28*b* and the lower section 28*c* are joined within the bottom bore portion 26 by the rod upper stop 30 to which they are threadly connected. Upper stop 30 is thereby mounted with the rod 28 and serves also as a coupling device. The upper stop 30 includes an annular inclined shoulder 30*a* which engages a downwardly facing internal stop shoulder 18*a* on hold-down body 10*e*, which provides a stop for the rod 28 on the upstroke. The rod bottom 28*d* is threadly connected to the rod lower stop 32. The lower stop 32 is a generally plug-shaped object with a rounded lower portion 32*a* to ease the lower stop's 32 flow through fluid. There is a generally cylindrical shaped middle portion 32*b* having a top shoulder portion 32*c*. The shoulder portion 32*c* is bevelled to a generally frusto-conical section to allow the shoulder portion 32*c* to cooperate with the lower cylindrical valve means 34.

The lower cylindrical valve means 34 includes a piston 35 formed by a generally cylindrical sleeve member 34*a* which is cylindrically or sleeve shaped. The outer diameter or the outer surface of the sleeve member 34*a* is just smaller than the inner diameter of the main cylinder 10*d* to allow the sleeve member 34*a* to slide in the bottom bore portion 26 and to form a sliding seal with the housing main cylinder 10*d* inner diameter.

The sleeve member 34*a* includes an internal hollow portion having an internal diameter greater than the outer diameter of the rod lower section 28*c*, which forms a space between the rod 28 and the sleeve member 34*a* to allow fluid to flow between them and to allow for relative movement between the piston rod 28 and the sleeve member 34*a* between the rod upper stop 30 and rod lower stop 32. Therefore the flow through the lower cylindrical valve means 34 may be changed by changing the diameter of the rod piston lower section 28*c*. The diameter of the rod piston 28*c* may be different than the diameter of the upper section 28*b*.

The lower cylindrical valve means 34 includes a top end portion 34*b* threadly connected to the top of the sleeve member 34*a* and a bottom end portion 34*c* threadly connected to the bottom of the sleeve member 34*a*. The sleeve member 34*a* and top and bottom ends 34*b* and 34*c*, respectively, are referred to as piston 35. This top end portion 34*b* has an outer diameter slightly less than the outer diameter of the sleeve member 34*a* and a flat top to meet the bottom of the rod upper stop 30. The inner diameter of the top end portion 34*b* is equal to the inner diameter of the sleeve member 34*a*. The bottom end 34*c* is similarly shaped. However, the lower edge of bottom end 34*c* is bevelled oppositely to the top shoulder portion 32*c* of the lower stop 32 so that they may form a seal when together. The outer diameter of the rod upper stop 30 and lower stop 32 are greater than the inner diameter of the end portions 34*b* and 34*c* to prevent the piston 35 sliding past either stop. The length of the sleeve member 34*a* is variable and may change from pump to pump depending upon well conditions. In general, the sleeve member 34*a* will be approximately one foot long per each thousand feet of well depth.

Referring additionally to FIG. 7, the upper cylindrical valve means 36 is located within the top bore portion 24. The upper cylindrical valve means 36 includes a hollow cylindrical or sleeve-shaped valve member 37, which is cylindrically or sleeve-shaped with an outer diameter approximately equal to the inner bore wall of the outlet cylinder housing 10*g* to form a sliding seal with the outlet cylinder 10*g*, and to allow movement within the top bore portion 24 between up and down positions in response to pressure from above and below. The inner diameter of the valve member 37 is approximately that of the outer diameter of the piston rod upper section 28*b* to mount the upper valve member 37 for slidable, sealed movement with respect to rod 28. The bottom end 37*a* of the valve member 37 is bevelled to form a downwardly facing surface tapered in a radially outward upwardly direction. This bevelled surface of bottom end 37*a* is complimentary to the upper surface of a seating surface 38*a* of seating ring 38 held by and between interior section cylinder 10*f* and outlet cylinder 10*g*. The bottom end 37*a* of upper valve member 37 cooperates with seating surface 38*a* to seal the upper bore portion 24 from the lower bore portion 26 when member 37 and ring 38 rest together. This seal will prevent fluid which has been pumped out of the bottom bore portion 26 from flowing back into bottom bore portion 26 during the downstroke of the pump P.

The top end 37*b* of member 37 as shown in FIG. 7 has a series of axial flutes 37*c* formed therein. The flutes 37*c* have a U-shaped cross-section with the size of the U recesses decreasing to zero in a vertically downward direction. Without the flutes 37*c*, there is a possibility in some well formations of sand gathering on top end 37*b* of the valve member 37 and eventually jamming the pump. The flutes 37*c* serve to promote flow of the fluid and thus of the sand away with the fluid, thereby preventing this jamming.

The length of this valve member 37 is variable and may be increased or decreased to increase or decrease the weight to affect the rising and lowering of the valve member 37 within the top bore portion 24. The angle of bevelling between the ring surface 38*a* and the bottom end 37*a* are preferably slightly different to cause an initial single line of sealing which would then wear into a better seating between them. Identical angles on surfaces 37*a* and 38*a* is undesirable because it is more likely that a single deformity would reduce the sealing capability. An angle of twenty-eight degrees is recommended for the bevelling on the sleeve shaped member bottom end 37*a* and a bevelled angle of thirty degrees is recommended for the seating surface 38*a* of the ring 38.

The housing outlet cylinder 10*g* is formed with outlet means generally designated as 40. Preferably the outlet means 40 consists of six holes 40*a* formed in the outlet cylinder 10*g* which are circumferentially spaced apart sixty degrees. The holes 40*a* are angled outwardly and upwardly with their lower-most point just above the ring 38 so that the holes 40*a* may be sealed and unsealed with minimum displacement of sleeve shaped valve member 37. The total cross-sectional area of the six holes 40*a* is smaller than the available cross-section of the housing 10 which will increase the fluid flow velocity from the outlet holes 40*a* to create a jetting action which will increase the efficiency of the pump when combined with an upward inclined direction for the outlet means holes 40*a*. The outlet means 40 will be sealed and unsealed by the vertical displacement of the upper cylindrical valving member 37.

Figure 2:
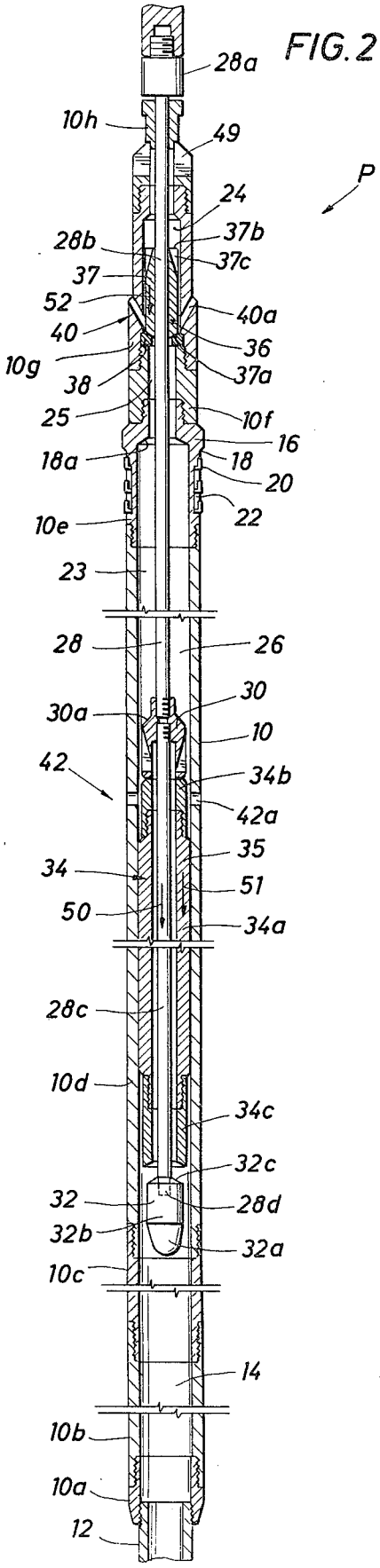
FIG. 2 is a cross-section of the pump at the end of a downstroke.
Figure 3:
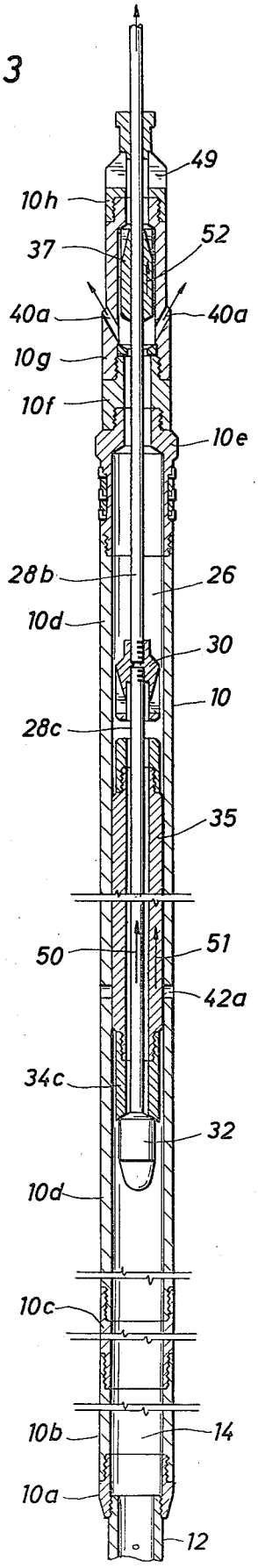
FIG. 3 is a cross-section of the pump during an upstroke.
Figure 4:
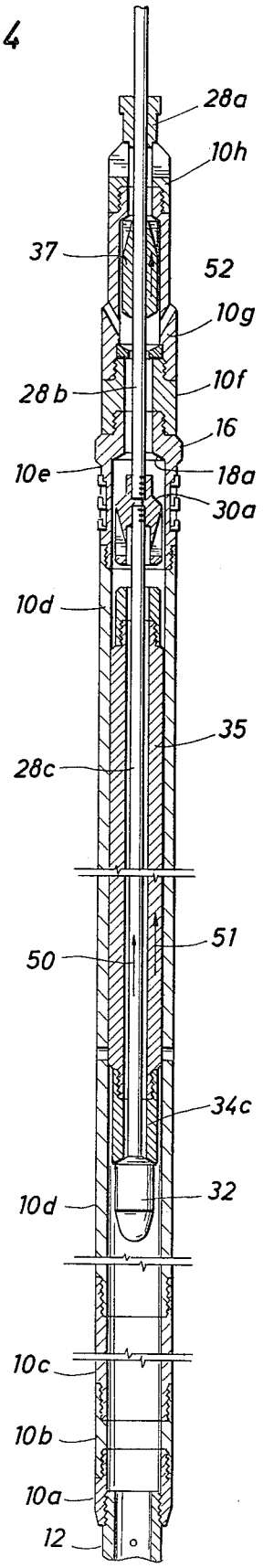
FIG. 4 is a cross-section of the pump at the end of an upstroke.

Within the housing main cylinder 10*d*, there is a side inlet means generally designated as 42 preferably formed by four circumstantially spaced holes 42*a*, approximately ninety degrees apart. The inlet holes 42*a* are positioned relative to the top and bottom of the downstroke of the lower cylindrical valving means piston 35. At the bottom of the downstroke, as seen in FIG. 2, the side inlet holes 42*a* are unsealed by the piston 35 of the lower cylindrical valving means 34. At that time, the pressure differential in the bottom bore portion 26, which is created as explained below, causes fluid from the formation S to flow into the bottom bore portion 26 above the piston 35. The diameter of each of the side inlet holes 42*a* will be determined by the amount of fluid desired to flow in to maximize efficiency. This will depend upon the time of the downstroke, the viscosity of the fluid F and the pressure of the formation S. As seen in FIG. 4, at the top of the upstroke the side inlet holes 42*a* are sealed by the piston 35, as they are during most of the upstroke and downstroke as seen in FIGS. 3 and 5.

OPERATION AND USE OF PUMP P

In describing the operation of pump P, a cycle for the pump may be described as one complete downstroke plus one complete upstroke of the rod 28. The relative positions of the lower cylindrical valve means piston 35 and the upper cylindrical valve means member 37 are dependent upon the position of the reciprocating rod 28. Referring to the figures, cycle points are as follows; the arrow 50 indicating the direction of travel of the piston rod 28, the arrow 51 indicating direction of travel of piston 35 and arrow 52 indicating direction of travel of member 37. FIG. 2 shows rod 28 at the end of a downstroke. FIG. 3 shows rod 28 during an upstroke. FIG. 4 shows rod 28 at the end of an upstroke. FIG. 5 shows rod 28 during a downstroke.

Figure 5:
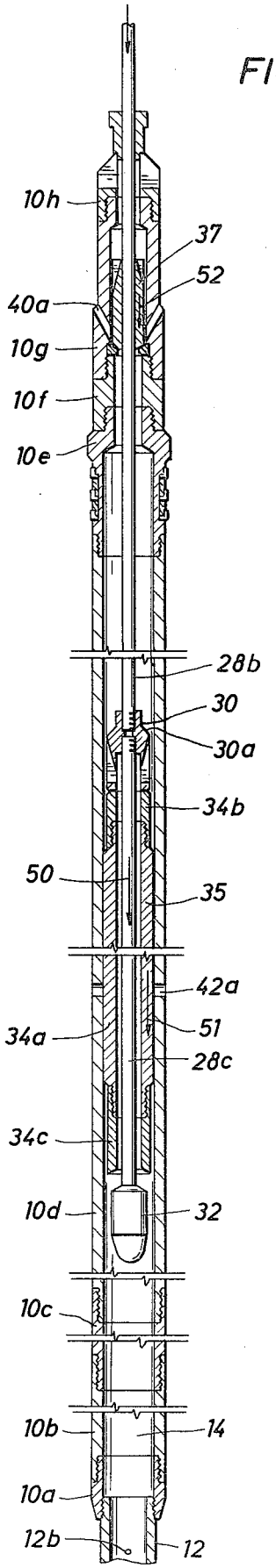
FIG. 5 is a cross-section of the pump during a downstroke.

During the downstroke as seen in FIG. 5, the sucker rods R move the rod 28 downwardly in direction of arrow 50. The weight of the fluid in the tubing T above the seating nipple N, exerted through circulating passageways 49 will cause the upper cylindrical valve member 37 to lower in the direction of arrow 52 to the seating ring 38, sealing the top bore portion 24 from bottom bore portion 26 and closing off the outlets 40*a* preventing fluid from flowing from the tubing T into top bore portion 24 or bottom bore portion 26. The pressure of the fluid in tube T will be carried by the member 37 and ring 38 so that during the part of the upstroke before member 37 is raised, less energy is needed to lift the fluid.

As the rod lower section 28*c* moves downwardly in bottom bore portion 26, the fluid within the bottom bore portion 26 will flow past the moving lower stop 32 and press upwardly against the piston 35, causing the piston 35 to raise up from the shoulder 32*c* of the stop 32, thus unsealing the bottom end portion 34*c* from the shoulder 32*c* of the lower stop 32. The piston 35 of the lower cylindrical valve means 34 will rise up relative to the piston rod section 28*c* until the top end portion 34*b* hits against the rod upper stop 30. There is thereby created a space for fluid flow between the inner diameter of the lower cylindrical valve means 34 sleeve member 34*a* and the rod 28. The top stop 30 has notches 30*a* cut therein to allow fluid flow through top stop 30. Piston 35 then moves downwardly, as indicated by arrow 52, pushed by rod upper stop 30.

Thus, as the rod 28 and the piston 35 of lower cylindrical valve means 34 are moved downwardly fluid will flow between them, out above the upper stop 30, and into the lower bore portion 26 above the piston 35.

In general, because the fluid flow will not be sufficiently swift, the available area above the downwardly moving piston 35 in bottom bore portion 26 will increase faster than the available area is filled by the fluid F, which will create a low pressure zone relative to the pressure of fluid F exterior of the pump P. This pressure differential will increase as the rod 28 continues downward until at the bottom of the downstroke as shown in FIG. 2, the side inlet holes 42*a* are momentarily opened. The fluid exterior to the pump will then flow inward through holes 42*a* into the bottom bore portion 26 above piston 35. The flow will be caused by the pressure differential.

In low viscous crude wells, or wells with high fluid pressure, the flow through the lower cylindrical valve means 34 may be sufficient to fill the bottom bore portion 26 above the piston 35 during the downstroke so that no side inlet means 42 is needed. Such a pump would be constructed without side inlet holes 42*a*.

During the upstroke as shown in FIG. 3, the piston 35 will come to rest on the lower stop 32 shoulder portion 32*c* to prevent the passage of fluid therebetween as the piston 35 is lifted on stop 32 moving with rod 28.

As the rod 28 is moved upwardly, as indicated by arrow 50, the fluid trapped in bottom bore portion 26 above the piston 35 will be lifted. The pressure differential between the fluid in bottom bore portion 26 and that external of the pump P will still be causing fluid to flow into the bottom bore portion 26 until now upwardly moving piston 35 rises the short distance required to seal the side inlet holes 42*a*. The side inlet holes 42*a* will remain sealed for the rest of the cycle. As the fluid is lifted upward, the fluid will pass through the interior of housing section 10*f* and pass seating ring 38 to move upper cylindrical valve means 36 valve member 37 upwardly causing the upper cylindrical valve means 36 to rise within the top bore portion 24. The fluid above valve member 37 within top bore portion 24 will exit the top bore portion 24 by circulating passageways 49 cut into upper end cylinder 10*g*. Circulating passageways 49 are four circumferentially spaced vertical notches which communicate with the fluid in tubing T.

The upward displacement of valve member 37 will unseal the outlet holes 40*a* to allow the fluid to flow outward. Because of the smaller diameter area of the outlet means holes 40*a* in comparison to the cross-sectional area of the housing 10, this fluid flow will be accelerated and because of the upwardly direction of nature holes 40*a*, a jetting action will occur to push the fluids out of the pump P, thereby increasing the efficiency of the pump.

The rod 28 will continue upward until it reaches the top of its upstroke, as shown in FIG. 4, which may be controlled by the length of the stroke of the sucker rods R above or by the physical blockage of the upper stop 30 by the inner diameter of the hold-down body 10*e* stop shoulder 18*a*.

Fluid will flow into the bottom bore portion 26 through the gas filter 12 and the bottom inlet 14. At the beginning of the downstroke, from the position of FIG. 4, the upper cylindrical valve member 36 is no longer held upward by the outflowing fluid and will descend in response to the fluid pressure in tube T in the top bore portion 24 to seal the outlet means 40 as the lower valve piston 35 is separated from downwardly moving lower stop 32 for the beginning of another cycle.

In less viscous wells, it may be desirable to add a third valve means 44 to the bottom inlet 14. Such a third valve means preferably is located, as shown in FIG. 6, in the housing lower end 10*b*. As shown in FIG. 8, in detail, the third valve means 44 includes an internal portion 44*a* as part of the housing section 10*b*, which provides a radially inwardly downwardly inclined seating surface 44*b*. A valve element 45 is formed by frustro-conical disc 45*a* having a vertical leg 45*b*, to which is secured a horizontal stop bar 45*c* to stop the upward motion of the valve element 45. The horizontal bar 45*c* is connected to the vertical leg 45*b* through a hole 45*d* in the horizontal bar 45*c*, the bar 45*c* being then secured to the vertical leg 45*b* by a nut 45*e*. The disc 45*a* would rest above the internal portion 44*a* and would seal the bottom inlet 14 when resting against the seating surface 44*b*. The lower surfaces of the disc 45*a* and the upper seating surface 44*b* are oppositely bevelled at slightly different angles to provide the preferable seating mechanism. This allows fluid to enter bottom bore portion 26 via the bottom inlet 14 but not exit.

This third valve element 45 is raised off of seating surface 44*b* during upstroke of rod 28 to allow fluid to flow into bottom bore portion 26. During downstroke, the valve element 45 is seated on seating surface 44*b* in order to trap fluid in bore 26, which fluid must then flow through the lower cylindrical valve means 34 into the area above the downwardly traveling piston 35.

ALTERNATIVE EMBODIMENT

Figure 9:
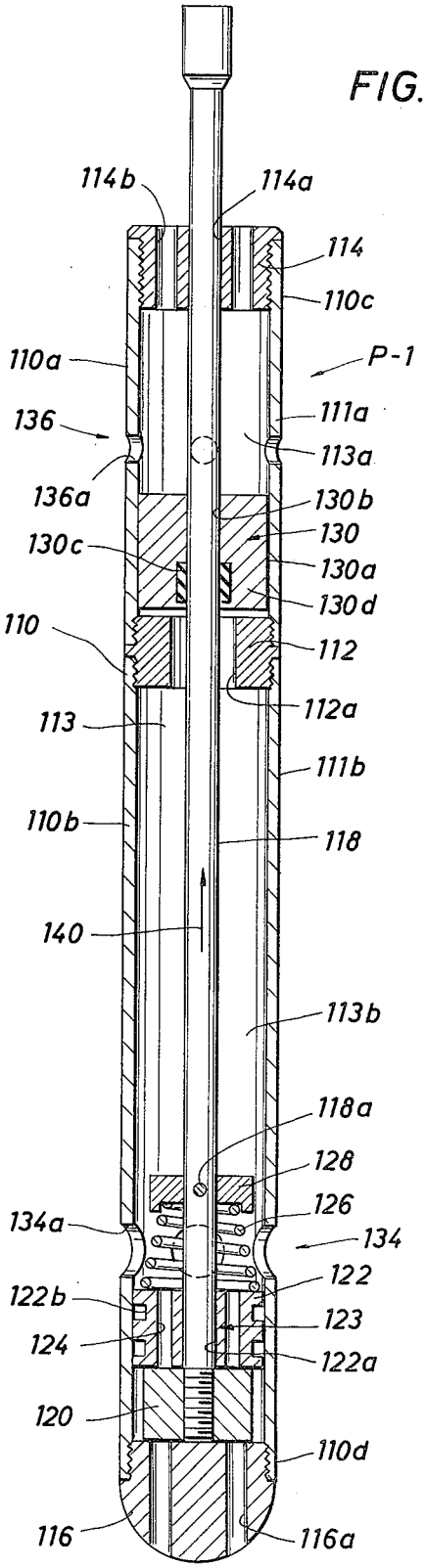
FIG. 9 is a cross-section of an alternative embodiment.

An alternative embodiment P-1 of the pump invention is shown in FIG. 9. In this embodiment, the generally cylindrical housing 110 is formed from an upper cylinder 110*a* and lower cylinder 110*b*, joined by interior connector section 112 which is a solid connecting member with external threads to be threadly secured to internal threads of the upper cylinder 110*a* and lower cylinder 110*b*.

The housing portion 110*a* terminate in top end 110*c* closed by a top end member 114. The top end member 114 has external threads secured to internal threads at top end 110*c* of the housing upper cylinder 110*a*. The housing lower cylinder 110*b* has a bottom end 110*d* closed by a bottom end member 116, which has external threads secured to internal threads at bottom end 110*d*.

The housing portions 110*a* and 110*b*, connecting member 112 and end members 114 and 116 cooperate to divide the hollow interior area into top bore portion 113*a* and a bottom bore portion 113*b* which together form a generally cylindrical bore 113.

The upper cylinder 110*a* in cooperation with the top end member 114 and the interior connector member 112 form an upper section 111*a*. The lower cylinder 110*b*, in cooperation with the bottom end member 116 and the interior connector member 112 form a lower section 111*b*.

The top end member 114 includes a center bore 114*a* of sufficient diameter to receive rod 118 therein. The top end member 114 further includes several vertical passages 114*b* to allow passage of fluid therethrough. The bottom housing plug 116 also includes several vertical passages 116*a* to allow fluid flow therethrough.

The rod 118 extends through the center bore 114*a* of the top end member 114, upper bore area 113*a*, hole 112*a* in the center of the connector member 112 and into the lower bore area 113*b*. The upper end of rod 118 is connected to a conventional reciprocal power means such as sucker rods to provide a rod upstroke and a downstroke.

The lower end of the rod 118 is threaded to receive a lower stop member 120. The lower stop member 120 is a cylinder with an inner diameter matching the threads of the rod 18 and an outer diameter sufficiently smaller than the inner diameter of the housing 110 to allow fluid to flow past it with ease. Above the lower stop member 120 is lower cylindrical valve means 123 which has a free floating piston 122 with an outer wall diameter approximating the inner diameter of the housing lower cylinder 110*b*, to allow piston 122 to be slidably, sealably mounted within the housing lower cylinder 110*b*. The floating piston 122 has a central bore 122*a* slidably mounting the piston 122 about the piston rod 118. Drilled vertically through the floating piston 122 are a series of vertical conduits 124 to allow fluid to flow through the piston 122 when the conduits 124 are not blocked by the lower stop member 120. Preferably, there are eight circumferentially spaced conduits 124 whose radially outermost edges are no further from the center of the rod 118 than the outer wall of the lower stop member 120 so that the lower stop 120 may act to prevent fluid flow through the conduits 124. Two junk grooves 122*b* are cut into the outer wall of piston 122 to prevent jamming of the piston 122 by junk. The free floating piston 122 will, absence other forces, be held against the lower stop 120 by a spring 126. Spring 126 is mounted about the piston rod 118 and is held in place by upper stop 128. Upper stop 128 is an annular ring mounted securely on the rod 118 with a hole (not shown) matching a hole 118*a* in rod 118 to receive and hold the end of spring 126. Upper stop 128 limits the upward displacement of piston 122 relative to rod 118.

Upper annular valve means 130 is a cylinder block 130*d* slidably mounted about the piston rod 118 within the upper bore area 113*a*. The outward wall 130*a* of cylinder block 130*d* forms a sliding seal with the inside wall upper cylindrical housing 110*a*.

The cylinder block 130*d* includes center bore 130*b* with conventional sealing 130*c* which mounts the cylinder block for slidably sealable movement with respect to the rod 118.

Side inlet means 134 consists of four holes 134*a* placed in the lower cylindrical housing circumferentially spaced ninety degrees apart. Holes 134*a* are located in the lower cylindrical housing 110*b* so as to be just above the free floating piston 122 when the piston rod is at its lowermost point; the position illustrated in FIG. 9.

Outlet means 136 consists of four holes 136*a* circumferentially spaced 90 degrees apart within the upper cylindrical housing 110*a*. The diameter of the holes 136*a* are smaller than the diameter of the side inlet means holes 134*a*. These holes 136*a* are located above the top of block 130*d* of the upper cylindrical valve means 130 when the block 130*d* is at its lowermost point in top bore portion 113*a*. The holes are below and unsealed by block 130*d* when it is at its uppermost point in the top bore portion 113*a*.

The operation of the pump is as follows: at the beginning of the upstroke of rod 118 and lower stop member 120, in the direction of arrow 140, the bore 113*b* lower cylinder housing 110*b* is at least partially filled with fluid. During upward movement, the free floating piston 122 is forced by spring 126 and the pressure of fluid in bore 113*b* against stop member 120 so that the conduits 124 are sealed. As the free floating piston 122 and lower stop 120 rise, the side inlets 134*a* are sealed and all fluid above the free floating piston 122 will be forced upward through the passage 112*a* in the connector section 112 and will move the cylindrical valve block 130 upwardly causing block 130 to rise within the upper cylindrical housing 110*b*. When the upper cylindrical valve block 130 has risen past the outlet holes 136*a*, the fluid will be forced out these holes. Because the diameter of the outlet holes 136*a* is smaller than the diameter of inlets 134*a*, the exit velocity of this fluid will be higher than the entering velocity of the fluid. The exiting of fluid will continue until the end of the rod upstroke.

As the rod 118 downstroke begins, the fluid pressure on the top of the upper cylindrical valve means 130 block 130*d* will force block 130*d* downward within the bore 113*a* of upper cylinder housing 110*a* causing outward wall 130*a* to seal off the outlets 136*a* preventing exited fluid from flowing back into the pump P-1. As the lower stop 120 and the free floating piston 122 move downward, a low pressure area will be created behind them within the lower cylinder 110*b*. The low pressure area in combination with the pressure of the fluid entering through inlets 134*a* and passageways 116*a* will force the free floating piston 122 upward against the force of spring 126 opening the conduits 124, thereby allowing fluid to flow through conduits 124 into the bore area 113*b* above the free floating piston 122. In this way no matter how great the fluid pressure from outside the pump P-1, the lower stop 120 and the piston rod 118 will be able to complete the downstroke. At the bottom of the downstroke, the side inlet means 134 will be unsealed and fluid will flow in response to the lower pressure in the bore 113*b* of lower cylinder 110*b*, filling at least partially the lower cylinder 110*b* above piston 122 and preparing the pump P-1 for the beginning of an upstroke as above stated. The holes 116*a* in end plug 116 form a bottom inlet to allow oil to flow into the bottom bore portion 113*b*. The holes 114*b* in top end cylinder 114 allow fluid to circulate in combination with the outlet 136*a* to reduce sand buildup and allow the upper annular valve means 130 to rise against less pressure.

What is claimed is:

1. A fluid pump, comprising:

a generally cylindrical hollow housing, forming a generally cylindrical bore;

said housing having upper and lower sections and an interior section which divides said bore into top and bottom bore portions;

a solid rod extending through said top bore portion and into said bottom bore portion, said rod having upper and lower stops mounted with said rod and positioned in said bottom bore portion;

said rod adapted for connection to reciprocal power means to impart reciprocal motion including a rod upstroke and a rod downstroke;

lower cylindrical valve means mounted on said rod for slidable movement with respect to said rod within said bottom bore portion between said first and second stops;

said rod lower stop preventing said lower cylindrical valve means from moving past said lower stop and forming a seal therewith during said rod upstroke;

said rod upper stop preventing said lower cylindrical valve means from moving past said upper stop during said rod downstroke, said lower cylindrical valve means being separated from said lower rod stop during said downstroke and including means allowing fluid flow therethrough;

upper cylindrical valve means mounted with said rod for slidable movement with respect to said rod within said top bore portion; said slidable movement along said rod between up and down positions being in response to pressure above and below said upper cylindrical valve means in said top bore portion;

said upper housing section having outlet means for providing fluid communication outward of said housing positioned in said top bore portion, which outlet means is sealed by said upper cylindrical valve means in said down position during said rod downstroke and at least partially unsealed during a portion of said rod upstroke when said upper cylindrical valve means is in said up position;

said housing lower section having side inlet means for allowing fluid flow into said bottom bore portion;

said housing lower section terminating in a bottom inlet allowing fluid to flow into said bottom bore portion;

said lower cylindrical valve means being removed from said lower rod stop during said rod downstroke to cooperate with said bottom inlet to allow fluid to flow through said lower cylindrical valve means into said bottom bore portion above said lower cylindrical valve means, and said side inlet means being open near the end of said rod downstroke to further allow fluid to flow into said bottom bore portion above said lower cylindrical valve means;

said outlet means being cylindrically shaped holes in said upper housing section which holes are directly outwardly and upwardly; and the total cross-sectional area of said cylindrically-shaped outlet holes is less than the cross-sectional area of said housing bore.

2. A fluid pump, comprising:

a generally cylindrical hollow housing, forming a generally cylindrical bore;

said housing having upper and lower sections and an interior section which divides said bore into top and bottom bore portions;

a solid rod extending through said top bore portion and into said bottom bore portion, said rod having upper and lower stops mounted with said rod and positioned in said bottom bore portion;

said rod adapted for connection to reciprocal power means to impart reciprocal motion including a rod upstroke and a rod downstroke;

lower cylindrical valve means mounted on said rod for slidable movement with respect to said rod within said bottom bore portion between said first and second stops;

said rod lower stop preventing said lower cylindrical valve means from moving past said lower stop and forming a seal therewith during said rod upstroke;

said rod upper stop preventing said lower cylindrical valve means from moving past said upper stop during said rod downstroke, said lower cylindrical valve means being separated from said lower rod stop during said downstroke and including means allowing fluid flow therethrough;

upper cylindrical valve means mounted with said rod for slidable movement with respect to said rod within said top bore portion; said slidable movement along said rod between up and down positions being in response to pressure above and below said upper cylindrical valve means in said top bore portion;

said upper housing section having outlet means for providing fluid communication outward of said housing positioned in said top bore portion, which outlet means is sealed by said upper cylindrical valve means in said down position during said rod downstroke and at least partially unsealed during a portion of said rod upstroke when said upper cylindrical valve means is in said up position;

said housing lower section having side inlet means for allowing fluid flow into said bottom bore portion;

said housing lower section terminating in a bottom inlet allowing fluid to flow into said bottom bore portion;

said lower cylindrical valve means being removed from said lower rod stop during said rod downstroke to cooperate with said bottom inlet to allow fluid to flow through said lower cylindrical valve means into said bottom bore portion above said lower cylindrical valve means, and said side inlet means being open near the end of said rod downstroke to further allow fluid to flow into said bottom bore portion above said lower cylindrical valve means;

said upper cylindrical valve means is a cylindrical member slidably mounted for movement with respect to said rod and having a top end with axially extending flutes.

3. A pump as in claims 1 or 2, wherein:

said outlet means being cylindrically shaped holes in said upper housing section which holes are directly outwardly and upwardly.

4. A pump as in claim 1 or 2, wherein:

said side inlet means is sealed by said lower cylindrical valve means during a substantial portion of movement of said lower cylindrical valve member upwardly within said rod; and said lower cylindrical valve means includes a generally cylindrical sleeve member having a bore of inner diameter larger than the diameter of said rod, said sleeve member being mounted about said rod for slidable movement between said rod stop members, said sleeve member engaging said lower rod stop on said rod upstroke and being separated therefrom on said rod downstroke to allow fluid flow between said rod and said sleeve member bore.

* * * * *